US010161682B2

(12) United States Patent
Gallagher et al.

(10) Patent No.: US 10,161,682 B2
(45) Date of Patent: Dec. 25, 2018

(54) INTEGRATED SENSOR SYSTEM AND METHODS FOR COMBUSTION PROCESSES

(71) Applicant: Air Products and Chemicals, Inc., Allentown, PA (US)

(72) Inventors: Michael J. Gallagher, Coopersburg, PA (US); Shailesh Pradeep Gangoli, Easton, PA (US); Aleksandar Georgi Slavejkov, Allentown, PA (US); Anup Vasant Sane, Allentown, PA (US); Reed Jacob Hendershot, Orefield, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 15/517,398

(22) PCT Filed: Oct. 9, 2015

(86) PCT No.: PCT/US2015/054880

§ 371 (c)(1),
(2) Date: Apr. 7, 2017

(87) PCT Pub. No.: WO2016/057892

PCT Pub. Date: Apr. 14, 2016

(65) Prior Publication Data

US 2017/0254593 A1 Sep. 7, 2017

Related U.S. Application Data

(60) Provisional application No. 62/062,578, filed on Oct. 10, 2014.

(51) Int. Cl.

| | |
|---|---|
| ***F27D 19/00*** | (2006.01) |
| ***F27D 21/00*** | (2006.01) |
| ***F27D 99/00*** | (2010.01) |

(52) U.S. Cl.

CPC ..... *F27D 19/00* (2013.01); *F27D 21/0014* (2013.01); *F27D 99/0033* (2013.01);
(Continued)

(58) Field of Classification Search

CPC ..... F27D 2019/0034; F27D 7/00; F27B 3/28; F27B 9/045; F27B 9/40; C21D 11/00; G05D 23/00

See application file for complete search history.

(56) References Cited

U.S. PATENT DOCUMENTS 4,028,083 A 6/1977 Patznick et al.
4,354,828 A 10/1982 Benton et al.
(Continued)

FOREIGN PATENT DOCUMENTS

EP 396164 A2 11/1990
EP 0675325 A1 10/1995
(Continued)

OTHER PUBLICATIONS

European International Search Report and Written Opinion of the International Searching Authority, dated Dec. 17, 2015, for PCT/US2015/054880.

*Primary Examiner* — Gregory A Wilson
(74) *Attorney, Agent, or Firm* — Larry S. Zelson

(57) ABSTRACT

An integrated sensor system for use in a furnace system including a furnace having at least one burner and two or more zones each differently affected by at least one furnace parameter regulating energy input into the furnace, including a first temperature sensor positioned to measure a first temperature in the furnace system, a second temperature sensor positioned to measure a second temperature in the furnace system; and a controller programmed to receive the first and second measured temperatures, and to adjust operation of a furnace system parameter based on a relationship between the first and second temperatures, thereby differentially regulating energy input into at least two of the zones of the furnace; wherein the relationship between the first and second temperatures is a function of one or more of a difference between the two temperatures, a ratio of the two temperatures, and a weighted average of the two temperatures.

14 Claims, 14 Drawing Sheets

(52) U.S. Cl.
CPC ..... *F27D 2019/004* (2013.01); *F27D 2019/0006* (2013.01); *F27D 2019/0015* (2013.01); *F27D 2019/0018* (2013.01); *F27D 2019/0021* (2013.01); *F27D 2019/0025* (2013.01); *F27D 2019/0028* (2013.01)

(56) References Cited

U.S. PATENT DOCUMENTS

| | | | | |
|---|---|---|---|---|
| 5,558,029 | A * | 9/1996 | Peake | F23G 5/10 110/185 |
| 7,404,670 | B2 * | 7/2008 | Willis | F27B 14/00 219/483 |
| 9,573,832 | B2 * | 2/2017 | Gaylo | C03B 23/0086 |
| 2006/0082034 | A1 * | 4/2006 | Rogers | B23K 1/008 266/87 |
| 2010/0077945 | A1 | 4/2010 | Hendershot et al. | |
| 2011/0113993 | A1 * | 5/2011 | Esmaili | F23N 1/002 110/186 |
| 2015/0081086 | A1 * | 3/2015 | Hallowell | F23G 7/10 700/209 |

FOREIGN PATENT DOCUMENTS

| | | | |
|---|---|---|---|
| EP | 2664884 | A1 | 11/2013 |
| WO | 2007085317 | A1 | 8/2007 |
| WO | 2012130725 | A1 | 10/2012 |

* cited by examiner

INTEGRATED SENSOR SYSTEM AND METHODS FOR COMBUSTION PROCESSES

CROSS-REFERENCE TO RELATED APPLICATIONS

This application claims the priority of U.S. Provisional Application No. 62/062,578, filed on Oct. 10, 2014, which is incorporated by reference herein in its entirety.

BACKGROUND

This application relates to an sensor system that is integrated into a furnace for improving operation of the combustion processes in the furnace, including but not limited to process efficiency, yield, and throughput.

Many industries use oxy-fuel combustion in a furnace for heating of bulk materials or feedstock but often have inadequate means to measure and control furnace parameters in order to optimize the heating processes. It is typical in a variety of industries (e.g., aluminum recycling, steel production, glass manufacturing) to place basic temperature sensors in locations around a furnace dictated by "common sense" or convenience, which often results in measurement errors and lost production capability.

Most typically, the rate of energy input in a heating or melting furnace is controlled based on comparing the temperature measurement of a thermocouple (TC) with a predetermined setpoint ($T_{sp}$). This thermocouple, denoted herein as $T_{OPEN}$, usually has three characteristics—(1) it is open or exposed to the furnace atmosphere, (2) it is located on a roof or an opposing wall from a burner and (3) it is installed flush with refractory hot face—the combination of which renders the TC susceptible to picking up "direct radiation" from a flame in the furnace just like other surfaces in the furnace (e.g., refractory walls and product surfaces). The charge or product being heated and/or melted is the largest heat sink in the furnace and is able to absorb (at its surface) and conduct (into the body of the charge due to its higher thermal conductivity) the incident energy. However, the refractory wall surface (which has a lower thermal conductivity) and open TC, $T_{OPEN}$, continue to be radiated upon and increase in temperature. This results in a deviation between the actual product temperature, $T_{PROD}$, (measured either at the product surface or as an average temperature of the bulk product), and in particular, $T_{OPEN}$ can exceed $T_{PROD}$ by a few or even several hundred degrees. As a consequence, the energy input into the furnace from the burners maybe prematurely decreased because the temperature of the control thermocouple $T_{OPEN}$ reaches the temperature setpoint $T_{SP}$ well before the actual product temperature $T_{PROD}$, thereby leading to longer heating and/or melting times than desired.

SUMMARY

Methods and systems are described herein which strategically position various combinations of sensors and/or sensor types in a furnace, such that the strategic placement (which may include physical co-locality of some or all of the sensors), creates an integrated sensor system that enables improved furnace control and operation. This results in enhanced process yields, efficiencies, and/or throughputs. Field and lab generated data demonstrate several surprising operational advantages that can be obtained using the methods and systems described herein.

Aspect 1. An integrated sensor system for use in a furnace system including a furnace and a flue, the integrated sensor system comprising: a sensor block configured to be mounted in a wall of the furnace system, the sensor block including at least two ports, each port being configured to receive a sensor; two or more sensors each positioned in a corresponding one of the ports in the sensor block; and a controller programmed to receive signals from the two or more sensors and to adjust operation of the furnace system in response to the received signals; wherein the two sensors are each selected from the group consisting of: temperature sensors, pressure sensors, composition sensors, concentration sensors, radiation sensors, density sensors, thermal conductivity sensors, optical sensors, acoustic sensors, level sensors, angle sensors, distance sensors, position sensors, image acquisition sensors, and video acquisition sensors.

Aspect 2. The integrated sensor system of Aspect 1, wherein the controller is programmed to monitor at least one of the sensor signals continuously.

Aspect 3. The integrated sensor system of Aspect 1, wherein the controller is programmed to monitor at least one of the sensor signals intermittently.

Aspect 4. The integrated sensor system of Aspect 1, further comprising an actuator mechanism corresponding to one of the sensors for advancing said sensor into a position for taking a measurement and retracting said sensor to a protected position; wherein the controller is programmed to monitor the signal from said sensor only when the sensor is advanced into the position for taking a measurement.

Aspect 5. A method of controlling energy input and energy distribution in a furnace using an integrated sensor system as in Aspect 1, wherein the two or more sensors include a first temperature sensor open to the furnace and second temperature sensor embedded in a wall of the furnace, comprising: controlling energy input into the furnace based on a signal from the second temperature sensor while controlling energy distribution based on a signal from the first temperature sensor, wherein the first temperature sensor responds more rapidly to local conditions that the second temperature sensor.

Aspect 6. A method of controlling energy input and energy distribution in a furnace using an integrated sensor system as in Aspect 1, wherein the two or more sensors include a first optical pyrometer or sensor directed at one location in the furnace and second optical pyrometer or sensor directed at another location in the furnace, comprising: controlling energy input into the furnace based on a signal from the second temperature sensor while controlling energy distribution based on a signal from the first temperature sensor, wherein the first temperature sensor responds more rapidly to local conditions that the second temperature sensor.

Aspect 7. A method of controlling one or more of excess oxygen, NOx, CO, and flammable emissions in a furnace using an integrated sensor system as in Aspect 1, wherein the two or more sensors include a pressure sensor and a composition sensor, comprising: controlling one or both of a flue gas damper and an oxygen-enrichment level in the furnace based on a signal from the pressure sensor, and controlling the oxy-fuel ratio of burners in the furnace based on a signal from the composition sensor.

Aspect 8. The method of Aspect 7, wherein the two or more sensors further include a temperature sensor, the method further comprising: restricting control of the flue gas damper, an oxygen-enrichment level in the furnace, and the oxy-fuel ratio of the burners based on a signal from the temperature sensor to maintain desired heat transfer.

Aspect 9. The method of Aspect 7, wherein the sensor block is located in the furnace.

Aspect 10. The method of Aspect 7, wherein the sensor block is located in the flue.

Aspect 11. A method of controlling furnace operation using an integrated sensor system as in Aspect 1, comprising: detecting opacity indicative of particles in one or both of the furnace and the flue; and adjusting furnace input parameters based on the detected opacity.

Aspect 12. The method of Aspect 11, wherein the two or more sensors include a sender and a receiver, and opacity is measured by attenuation of a signal from the sender to the receiver.

Aspect 13. The method of Aspect 11, wherein the two or more sensors include a radiation receiver, and opacity is measured by attenuation of furnace radiation that would otherwise be detected in the absence of particles.

Aspect 14. The method of Aspect 11, further comprising: detecting one or more predetermined particle sizes as indicative of non-optimized combustion; and adjusting furnace input parameters based on the detected particle sizes.

Aspect 15. A method of controlling heat distribution in a furnace using one or more integrated sensor systems as in Aspect 1, comprising: detecting heat load in one part or zone of the furnace; detecting heat load in another part or zone of the furnace; adjusting the input of combustion energy to the respective parts or zones of the furnace based on the detected heat loads.

Aspect 16. An integrated sensor system for use in a furnace system including a furnace having a flue and at least one burner introducing fuel and oxidant into the furnace, the furnace containing a charge and having walls bounding a furnace environment, the walls including at least one of a side wall, an end wall, and a roof, the furnace having two or more zones each differently affected by at least one furnace parameter regulating energy input into the furnace, the integrated sensor system comprising: a first temperature sensor positioned to measure a first temperature in the furnace system; a second temperature sensor positioned to measure a second temperature in the furnace system; and a controller programmed to receive signals from the first and second temperatures sensors indicative of the first and second measured temperatures, respectively, and to adjust operation of a furnace system parameter based on a relationship between the first and second temperatures, thereby differentially regulating energy input into at least two of the zones of the furnace; wherein the relationship between the first and second temperatures is a function of one or more of a difference between the two temperatures, a ratio of the two temperatures, and a weighted average of the two temperatures.

Aspect 17. The system of Aspect 16, wherein the first temperature sensor is mounted in a wall in a first zone of the furnace and exposed directly to the furnace environment; and wherein the second temperature sensor is embedded in a wall in the first zone of the furnace and isolated from direct exposure to the furnace environment.

Aspect 18. The system of Aspect 16, wherein the first temperature sensor is an optical sensor oriented to detect the temperature of the charge in a first zone in the furnace; and wherein the second temperature sensor is an optical sensor oriented to detect the temperature of the charge in a second zone in the furnace.

Aspect 19. The system of Aspect 16, wherein the first temperature sensor is an optical sensor oriented to detect the temperature of the charge in a first zone in the furnace; and wherein the second temperature sensor is embedded in a wall in the first zone of the furnace and isolated from direct exposure to the furnace environment.

Aspect 20. The system of any of Aspects 16 to 19, wherein the furnace system parameter to be adjusted includes at least one of a burner firing rate, a burner stoichiometry, a burner staging, a firing rate distribution among two or more burners, a staging distribution among two or more burners, and a furnace pressure.

Aspect 21. The system of any of Aspects 16 to 20, wherein the controller is programmed to monitor at least one of the temperature sensor signals intermittently.

Aspect 22. The system of any of Aspects 16 to 21, further comprising at least a third sensor selected from the group consisting of: temperature sensors, pressure sensors, concentration sensors, radiation sensors, density sensors, optical sensors, acoustic sensors, level sensors, angle sensors, distance sensors, position sensors, image acquisition sensors, and video acquisition sensors.

Aspect 23. The system of Aspect 22, further comprising an actuator mechanism corresponding to the third sensor for advancing the third sensor into a position for taking a measurement and retracting the third sensor to a protected position; wherein the controller is programmed to monitor the signal from third sensor only when the third sensor is advanced into the position for taking a measurement.

Aspect 24. The system of any of Aspects 16 to 23, further comprising: a sensor block mounted in a wall in a first zone of the furnace and having at least two ports in which the first and second temperature sensors are respectively positioned.

Aspect 25. A method of controlling one or both of energy input and energy distribution in a furnace using an integrated sensor system as in Aspect 16, comprising: receiving a first temperature signal from the first temperature sensor to determine the first temperature; receiving a second temperature signal from the second temperature sensor to determine the second temperature; adjusting a furnace system parameter based on a relationship between the first and second temperatures, wherein the furnace system parameter includes at least one of a burner firing rate, a burner stoichiometry, a burner staging, a firing rate distribution among two or more burners, a staging distribution among two or more burners, and a furnace pressure, thereby differentially regulating energy input into at least two of the zones of the furnace.

Aspect 26. The method of Aspect 25, further comprising: controlling energy input into the furnace based on a signal from the second temperature sensor; and controlling energy distribution into the furnace based on a signal from the first temperature sensor; wherein the first temperature sensor responds more rapidly to changes in the furnace environment than the second temperature sensor.

Aspect 27. The method Aspect 25, further comprising: calculating a ratio of the first and second temperatures; and controlling one or both of the energy input and energy distribution based on the calculated ratio.

Aspect 28. The method of Aspect 25, wherein the first temperature sensor is mounted in a wall of the furnace and exposed directly to the furnace environment and the second temperature sensor is embedded in a wall of the furnace and isolated from direct exposure to the furnace environment; and wherein the controlling step includes adjusting energy input into the furnace based on a function of one or more of the difference between the first and second temperature sensor, the ratio of the first and second temperature, and a weighted average of the first and second temperatures.

Aspect 29. The method of Aspect 25, wherein the first and second temperature sensors are optical pyrometers each directed at a different one location in the furnace, wherein the controlling step includes adjusting energy distribution into the furnace based on a function of one or more of the difference between the first and second temperature sensor, the ratio of the first and second temperature, and a weighted average of the first and second temperatures.

Aspect 30. A method of controlling heat distribution in a furnace using one or more integrated sensor systems as in Aspect 16, comprising: detecting a heat requirement in one zone of the furnace; detecting a heat requirement in another zone of the furnace; and adjusting the input of combustion energy to the respective parts or zones of the furnace based on the detected heat loads.

Aspect 31. The system as in Aspect 16, wherein the temperature sensors may be contact or non-contact.

Aspect 32. The system as in Aspect 1, further comprising: two or more sensors each positioned in a corresponding one of the ports in the sensor block; and a controller programmed to receive signals from the two or more sensors and to adjust operation of a furnace system parameter in response to the received signals; wherein the two sensors include at least two temperatures sensors configured to measure two different temperatures in the furnace system; and wherein the wall of the furnace is one or more of a sidewall and a roof of the furnace.

DETAILED DESCRIPTION

Figure 1:
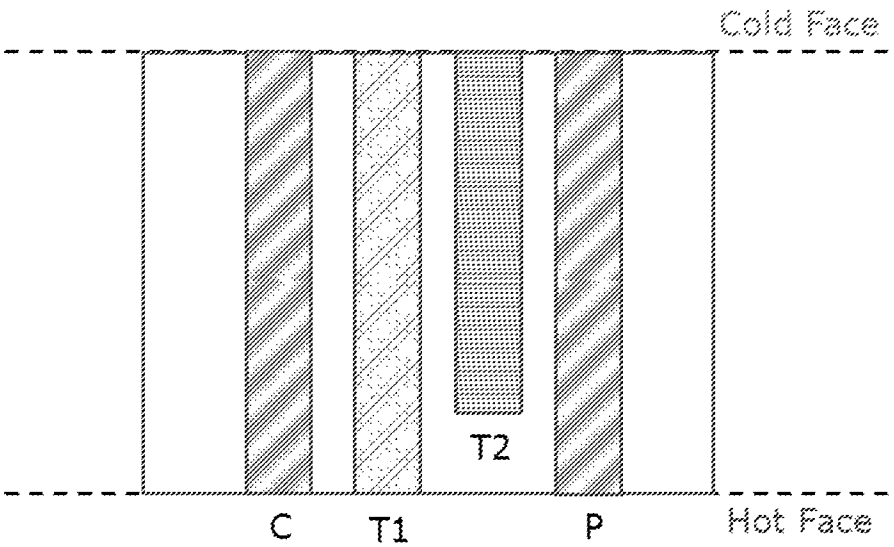
FIG. 1 is a cross-sectional schematic view of an exemplary sensor block having three through ports and one blind port, each configured to receive one or more sensors, and indicating an exemplary arrangement of three sensors exposed to the furnace environment, composition (C), temperature (T1), and pressure (P), as well as one sensor embedded in the sensor block, temperature (T2).

An integrated sensor system has been developed to work synergistically with one or more burners in a furnace, by using feedback from two or more sensors installed in the furnace at one or more locations, to optimize process efficiency, yield and/or throughput.

A non-limiting list of the types of sensors that can be used, separately or in combination, in an integrated sensor system, is as follows:

Temperature (T) sensors, contact or non-contact, such as thermocouples, optical pyrometers, thermistors
Density sensors
Distance sensors—1D or 2D topographic sensors
Sensors that measure thermal conductivity
Devices capable of video or image acquisition
Optical sensors that determine information based on specific wavelengths or overall intensity of light
Acoustic sensors
Level and/or angle measurements
In-situ composition sensors like oxygen sensors (zirconia)

The integrated sensor system maybe wired or wirelessly connected, so the furnace can be stationary or rotational in operation. The integrated sensor system may be powered using a battery, wired-in power, or via energy harvesting from the furnace (e.g., using vibration, heat, mechanical movement, optical methods for energy harvesting).

Features of an Integrated Sensor System.

Sensors can be used for continuous or discontinuous measurement of process variables in a furnace. As a non-limiting example, continuous measurement can be performed by one or more thermocouples installed, each either embedded or open to the furnace atmosphere, and continuously measuring the temperature(s) in the furnace.

Alternatively, sensors may be mounted on an actuated mechanism that introduces the sensor into the measurement space and takes a discontinuous point measurement (in space and/or time) that is used, either in real-time or in a time-integrated manner, in the decision making process for control of the furnace. The use of an actuation mechanism that houses sensors also potentially eliminates or reduces the need for cooling, by water or air or other means, of a sensor that may not be suitable for continuous exposure to a furnace environment.

When using certain optical sensors, e.g., an infrared pyrometer, an image acquisition device, and the like, it is possible to have interference in measurement signals due to intense radiation from a flame. To address this, the actuation mechanism may be synchronized with the operation of a flame or flames, so that the sensor is actuated into position only when a flame or flames are least likely to interfere with measurements. This synchronization with a flame or flames would be beneficial to obtain more accurate data from the furnace, but is not necessary. The optical pyrometers may be configured to detect emissions in one or more wavelength ranges, for example, from 0.9 to 1.1 micrometers, from 1.5 to 1.7 micrometers, from 2.0 to 2.4 micrometers, from 3.8 to 4.0 micrometers, or combinations thereof, noting that a pyrometer need not be able to detect all of the wavelengths in any particular range.

In one example, an image acquisition device is used to take multiple photographic images in the furnace, and then a post-processing algorithm fuses or stitches those images together to provide a furnace overview. In addition, temperature and topographic information (obtained by nearly simultaneously operating sensors) may be overlaid on the furnace overview. This information can be used, for example, to determine the energy distribution required in a furnace having two or more zones each differently responsive to certain energy inputs (e.g., burners or burner configurations or operating parameters) into the furnace, as discussed in further detail below.

The integrated sensor system includes a sensor block that may have any number of channels, holes, passages, wells, or ports for sensors of various shapes and sizes, and any number of sensors may be used at any given time. Further, depending on the needs of the operation, the sensors within the integrated sensor system may be installed flush or extended into the furnace, or recessed into the refractory block, as shown in FIG. 1. In addition, the sensor block or other components of the integrated sensor system may or may not be actively cooled (e.g. water, air, or electrically) depending on installation methodology mentioned above and temperatures in the process.

FIG. 1 shows a schematic representation of a sensor block for an integrated sensor system in which a refractory block houses one or more sensors to measure critical process variables, which may include temperature (T), pressure (P) and composition (C) and other secondary process variables such as distance, topography, angles, or other relevant parameters.

Role of Components.

One or more process sensors may be located in the integrated sensor system, dictated by the needs of the control strategy being employed. Depending on the control needs of the application, a combination of sensors maybe ranked and weighted per their importance in the control strategy. In one non-limiting example, when managing the energy input and distribution needs of the furnace, a combination of temperature sensors may be used and weighted in the decision making. In another non-limiting example, when managing the excess oxygen concentration in the flue duct, a combination of pressure and composition sensors maybe used and weighted in the decision making. Note that any one type of process sensor, by itself, may be inadequate to define the control needs. Therefore, knowledge and understanding as to how a combination of variables respond, for example at a particular strategically-selected location or locations, can be instrumental in effectively determining how to control the combustion process in the furnace.

A package of information obtained from synergistically operating sensors in the integrated sensor system can be effectively used to control aspects of the furnace operation such as energy distribution, energy input (firing rates), stoichiometry, and/or to identify events such as substantial completion of process melting, and/or to determine suitable times for the next incremental charge, addition of salts/fluxes, stirring the metal bath, dealing with contaminated scrap, need for post combustion, control of emissions, adjustment of the burner staging either fuel or oxygen, material refining (e.g., oxidation or reduction), and other process steps or events.

Sensors may operate individually or in combination with other sensors in the integrated sensor system or a combination of integrated sensor systems.

Locating the sensors for the integrated sensor system.

The performance of integrated sensor system is significantly affected by the location of its sensors. In one embodiment, one or more sensor blocks may be strategically located in the roof and/or side-walls and/or flue gas duct, in order to get a complete picture of the control needs of a furnace, because every furnace is different. Many factors, including but not limited to the number, location and type (air-fuel, air-oxy-fuel, or oxy-fuel) of burners, energy input, size and shape of furnace, and location of the flue duct relative the burners, determine the fluid dynamic patterns of flue gases and heat release that develop in the furnace. These in turn help determine the appropriate location of sensors in the furnace.

One or more sensor blocks may be installed standalone or independently in the furnace or may be integrated within the burner system. Depending on the needs of the operation, the sensor blocks may be installed flush (preferably) or extended into the furnace or recessed into the furnace refractory.

Figure 2:
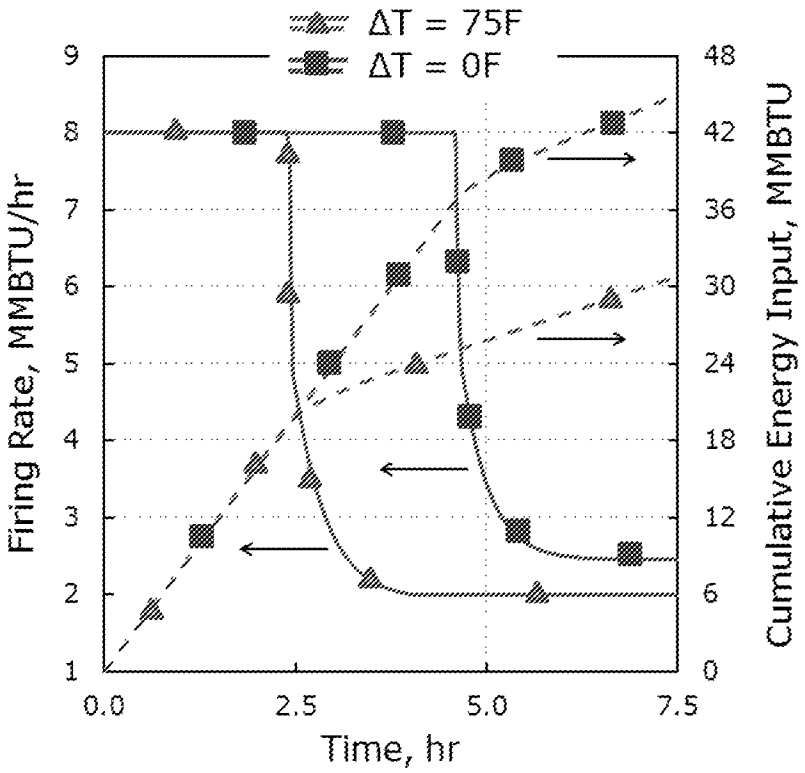
FIG. 2 is a graph showing the benefit of having properly positioned thermocouples for controlling energy input. When thermocouples (TCs) are not located appropriately, the energy input into the furnace can be reduced prematurely. Square symbols denote an appropriately located control TC to detect a temperature accurately indicative of the charge temperature, while triangle symbols denote a scenario where a control TC is misplaced so as to detect a temperature approximately 75° F. higher than that detected by an appropriately located control TC.

As shown in FIG. 2, when thermocouples (TCs) are not located appropriately, the energy input into the furnace can be reduced prematurely. In the lower firing rate and cumulative energy curves (triangle symbols), a control thermocouple was located in a place that caused it to read approximately 75° F. higher than a more appropriately placed thermocouple, resulting in a premature reduction of firing rate and insufficient cumulative energy input into the furnace. In the higher firing rate and cumulative energy curves (square symbols), a control thermocouple was appropriately placed for the process, resulting in longer firing at a higher rate and a higher cumulative energy input into the furnace.

Figure 3:
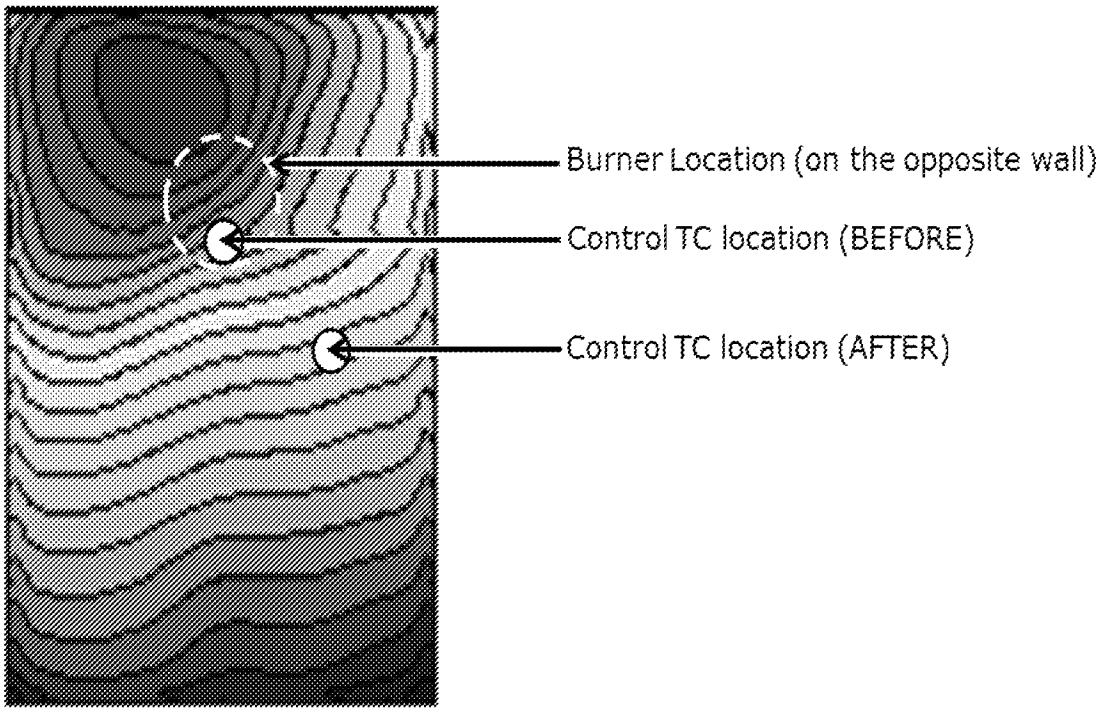
FIG. 3 is a graph showing CLOP output ranking the locations for placement of control thermocouple for most effective control strategy. Dark shaded regions in the upper portion of the figure (near the burner) indicate worse locations and dark shaded regions in the lower portion of the figure (away from the burner) indicate better locations.

An example of the importance of locating thermocouples (TC) in a reheating furnace to control the rate of energy input (instantaneous burner firing rate) in the process can be understood with reference to Gangoli, et. al., "Importance of Control Strategy for Oxy-Fuel Burners in a Steel Reheat Furnace," PR-364-181—2013 AISTech Conference Proceedings, which is incorporated herein by reference in its entirety. A Control Location Optimizer Program (CLOP) uses a unique strategy to determine the effective location of the control TC. FIG. 3 shows the effect of non-optimal location of TC in the furnace (see location BEFORE). As shown in FIG. 3, locating a thermocouple (TC) too close to the burner yields suboptimal results (the "BEFORE") location, whereas improved results can be obtained by locating the thermocouple sufficiently away from the burner (the "AFTER") location.

By moving the control TC location to AFTER, the cycle times and fuel savings obtained in the process improved by 29% (faster) and 20% (lower), respectively.

Examples of Control Strategies using an integrated sensor system:

A) Controlling Energy Input and Energy Distribution in a furnace.

In a scenario when standard (e.g., type- K) thermocouples are used to control energy input and distribution of energy in the furnace, it is preferred to use them in pairs, or at least to use at least one thermocouple that is open to the furnace environment and radiation and at least another thermocouple that is embedded in a refractory block, typically 1 to 2 inches from the hot face. This arrangement may be implement using a sensor block as shown in in FIG. 1, with T1 (open) and T2 (embedded) thermocouples. One or more sensor blocks maybe located in the furnace (e.g., in one or more of a roof or a sidewall or a flue gas duct).

The embedded TC reacts slower while the open or exposed TC reacts faster to the changes in the process. Similarly, the overall energy input needed by the furnace changes slower (usually linear for given rate of scrap input), while the heat distribution needs change faster (melting/movement of scrap, furnace events such as charging, stirring, etc.). Consequently, a control strategy incorporating the integrated sensor system can use the open TC to control heat distribution decisions and the embedded TC to manage the overall energy input into the furnace.

When an open or exposed thermocouple is used to control the rate of energy input into the furnace, it is prone to picking up heat much faster than surrounding refractory and product within the furnace. This causes a premature reduction of energy input into the furnace leading to extended cycle times (see FIG. 2). This effect is amplified when an open TC is used in combination with a highly radiant oxygen-enriched-air or oxy-fuel flame operation.

B) Controlling excess-$O_2$ in the furnace.

Sensors may be located close to or in the flue gas duct. In this situation, pressure and composition (e.g., $O_2$ concentration) process variables may be used as the primary inputs to the decision making, while temperature can play a secondary role as an input to the decision making. For example, pressure is used to control the flue gas damper or oxygen-enrichment level in the furnace and consequently air leakages (leakage of $O_2$), while composition is used to control the oxygen-to-fuel ratio used in combustion and consequently furnace pressure. In this scenario, it is preferable to have the pressure and composition sensors at the same location (i.e., incorporated into the same sensor block) because oxygen concentration is interconnected to pressure and composition variables. The temperature information could then be used as a check to make sure that the changes made to the furnace do not adversely affect heat transfer.

C) Controlling NOx in the furnace.

Sensors may be located close to or in the flue gas duct. In this situation, pressure and composition process variables maybe used as primary inputs in the decision making, while temperature can play a secondary role, so that the stoichiometry of burners can be adjusted based on each burner's location relative to the flue and burners' relative to each other.

D) Detection of particulates in the flue gas duct.

i) Active detection, using a sender and a receiver, where attenuation in signal indicates presence of particulates. For example, a particulate detector such as sold commercially by Forbes Marshall (e.g., Opacity/Dust Monitor—FM CODEL DCEM2100) may be integrated with a sensor block and the furnace controls. Controlling the opacity of a flue by adjusting control parameters has also been shown in at least one test case (see http://lehigh.edu/energy/leu/leu_54.pdf).

ii) Passive detection, using furnace radiation and a receiver, where attenuation in signal indicates presence of particulates. This method uses a light sensitive detector (e.g. photodiode, CCD) that, in the absence of particulates, would measure light from a hot refractory, flame, or other surface emitting radiation. The presence of particulates reduces the light intensity. However a reduction in furnace temperature, firing rate, or other item could also reduce the intensity observed by the light sensitive detector. Therefore a synthesis of information is needed to determine the cause of the reduction in light. For instance by combining information about the burner(s) firing rate, furnace temperature, sensor block temperature, other light sensitive detectors, and/or other information, the controls for the furnace can determine if the reduction in light intensity is due to particulates blocking the light source or a reduction in background radiation. This would eliminate the problems associated with alignment of (active) catch and receive devices. Once there is a determination that there are additional particulates, the combustion/furnace controls could be adjusted/optimized to reduce particulates or other non-optimized combustion conditions. This could be from improved combustion using known techniques such as improved stoichiometry control, improved flame stability, and the like.

iii) Use a specific wavelength to distinguish between particulates.

Knowing the distribution of particulate sizes could be useful for determining the source of the particulates. For instance, larger particle sizes may indicate that a pulverizer is not operating properly and smaller sizes may indicate non-optimized combustion in the burner, both in the case of solid fuel combustion. Similarly the particle size could indicate if the particle is a combustion product or if it was picked up from the heated material due to gas currents within the furnace. It may also be important to know the particle size for permitting reasons. The particle size could be inferred by using different wavelengths of light either through the use of catch and receive optics using lasers, filters, or gratings or through the use of background radiation and optical filters or gratings (or other means). With this information the combustion could be adjusted, a warning provided for combustion related equipment, the gas flows in the furnace could be adjusted to reduce particle pick-up, and/or other actions could be taken to rectify the issue. Note also that the detection of specific wavelengths can be done using either passive or active detection as discussed above.

E) Controlling CO/flammables emissions from the furnace.

Various means can be used to control the CO/flammable emissions. For example, the method described in US2013/0307202, incorporated herein by reference in its entirety, could be employed using a sensor block to incorporate both the optical detector and temperature measurement device. Beyond controlling for unexpected volatiles, the same sensors or different sensors could be used to control the furnace at minimum excess oxygen based on the emissions of flammables from the furnace. Such flammables would be the result of imperfect control by the control system, imperfect mixing of oxygen and fuel within the burner and/or furnace, and/or from the charge or other sources. However, as differentiated from the control methodology of the '202 patent application, the burner flow control stoichiometry can be controlled in a narrower range. One objective of the present application is to minimize excess $O_2$, wherein the burner input flows can be slowly changed to new setpoints in response to the sensor system inputs. This slowly changing control system allows for minor modifications to the stoichiometry to account for the dynamics in the furnace while maintaining the ability to respond to more major changes in the system.

F) Controlling "heat distribution" using an integrated sensor system.

Figure 4:
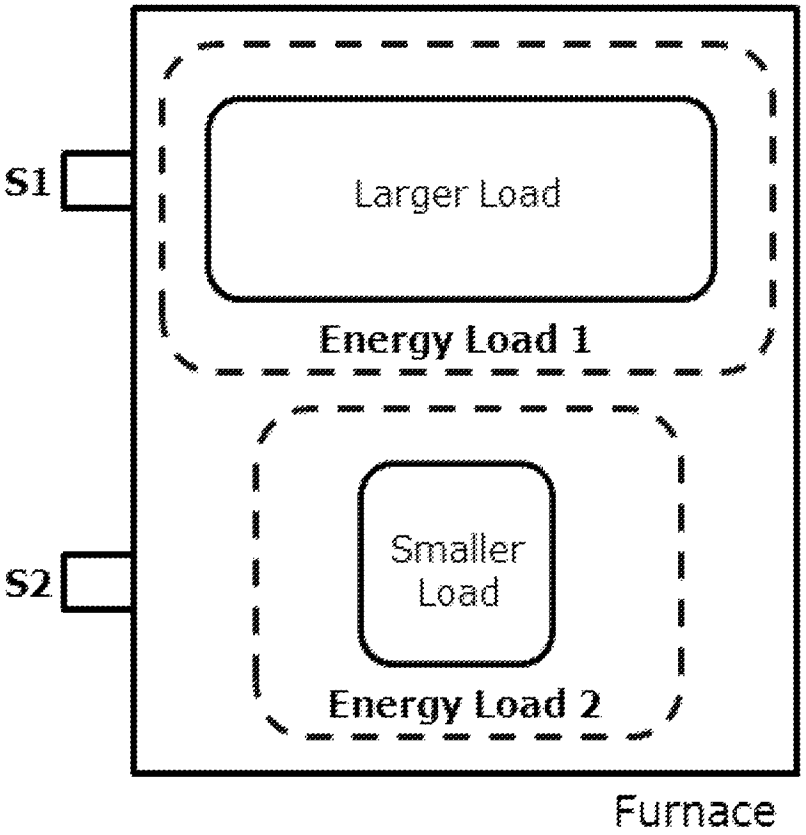
FIG. 4 shows exemplary integrated sensor systems S1 and S2 strategically installed to sense heat distribution needs in a furnace having two zones, one with a smaller energy load or requirement, and the other with a larger energy load or requirement.

As shown in FIG. 4, integrated sensor systems S1 and S2 may be strategically installed to sense heat distribution needs of different zones in a furnace, and corresponding to these heating needs, appropriate amount of Energy loads 1 and 2 are distributed in the furnace, for example using a burner capable of adjusting its zonal heat distribution (e.g. different levels of fuel or oxygen staging or other means) or by using a combination of strategically located burners.

When used in a melting application (e.g., secondary aluminum or copper melting), the product load can potentially move around the furnace due to lopsided charging practices, movement of solids in the furnace via melting, molten metal pumps, or other causes. In this case, the integrated sensor systems can detect the relative zonal changes in the load and make adjustments to the heat distribution accordingly.

Scope of use of integrated sensor system.

The integrated sensor system may be used in a wide variety of energy applications including melting, heating/reheating, secondary ferrous/non-ferrous metal refining, (high temperature applications) for all metals, glass, gasification, direct reduced iron, boilers, reformers (add others), as non-limiting examples.

Experimental Data.

In addition to control, temperature setpoints are often used to prevent over heating of a charge or product in a furnace more so than to protect the refractory, simply because most refractories in heating or melting furnaces are rated for working temperatures far higher than target process temperatures of the product. For example, some refractories can handle temperatures in excess of 3000° F., while a product in the furnace may melt or become oxidized (in situations where it is desired to avoid melting and/or oxidation) well below those temperatures. However, control based on an open thermocouple $T_{OPEN}$ that overestimates the product temperature (as discussed above with regard to FIG. 2) may be overly conservative, putting much less heat into the furnace than desired to achieve optimal heating or melting rates of the product. As described herein, an improved method recognizes the benefits of controlling furnace operation in a way that allows $T_{OPEN}$ to exceed the temperature setpoint by relying on a function of one or more temperature measurements to more accurately indicate one or both of the actual product temperature and the actual refractory temperature in the furnace.

The lagging of product temperature $T_{PROD}$ as compared with $T_{OPEN}$ can be simulated with the help of an embedded thermocouple, $T_{EMB}$ that serves as a reasonable proxy for $T_{PROD}$. For example, in a sensor block as illustrated schematically in FIG. 1, $T_{OPEN}$ may be positioned in the port denoted T1 while $T_{EMB}$ may be positioned in the port denoted T2. As the name suggests, an embedded TC is installed such that no portion of the TC is exposed to atmosphere in the furnace and hence, $T_{EMB}$ is not radiated upon directly by the flame. $T_{EMB}$ measures the gross refractory temperature, which is relatively less responsive than $T_{OPEN}$ to local effects inside the furnace. The amount or temperature difference by which $T_{EMB}$ lags $T_{OPEN}$ depends on multiple factors, including the depth of TC embedment from the refractory hot face (typical from about 0.5 to about 3 inches) and the conductivity and thermal capacity of the refractory.

Figure 13:
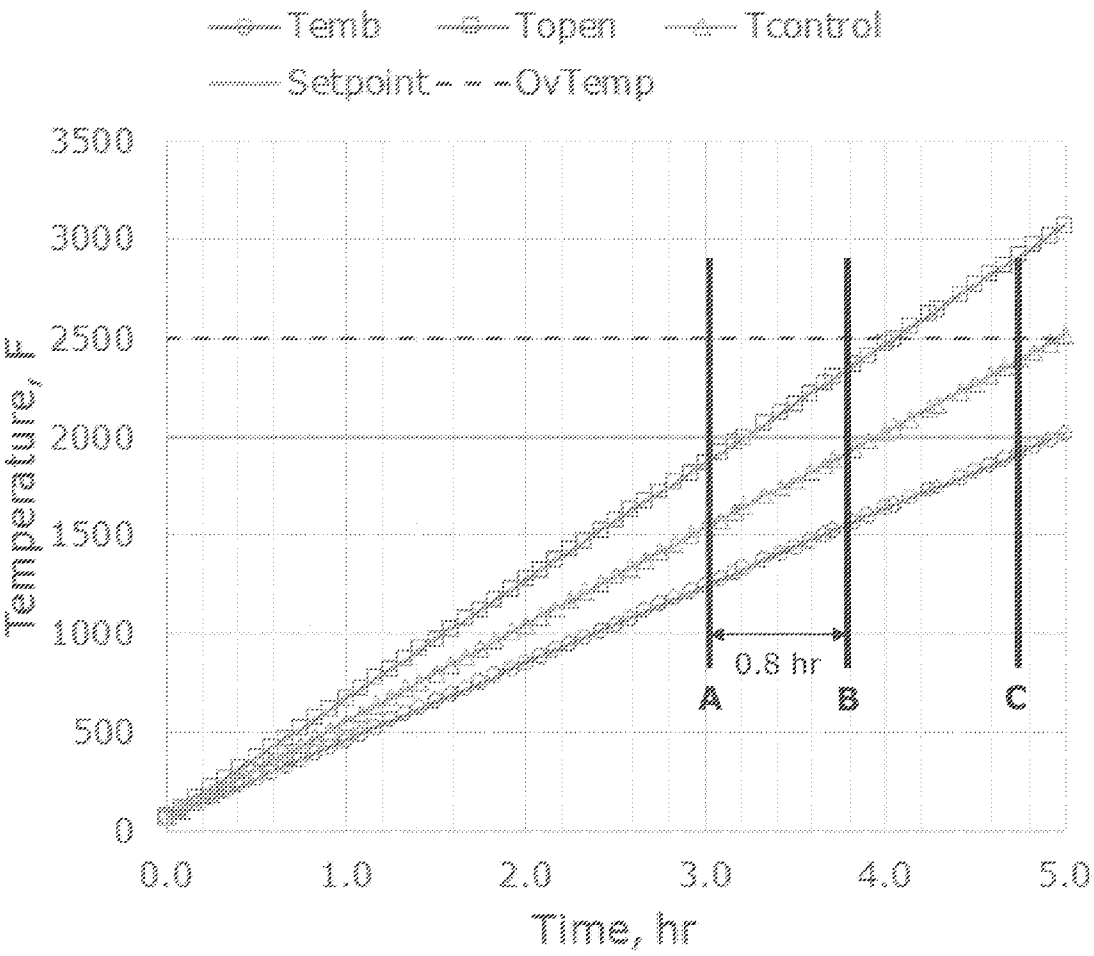
FIG. 13 is a graph showing a control comparison of three scenarios for heating a charge in a furnace, with control based on: (1) an open thermocouple alone (square symbols, top line) which results in the soonest reduction in energy input to the furnace and thus longer melting or heating times, (2) an embedded thermocouple alone (circle symbols, bottom line) which results in the latest reduction of energy input into furnace and potential refractory overheating, and (3) an control strategy based on a function of both the open and embedded thermocouples (triangle symbols, middle curve), resulting in faster heating times than the open thermocouple control scheme while avoiding the potential overheating concerns of the embedded thermocouple control scheme.

FIG. 13 shows an example scenario in which $T_{OPEN}$ is assumed to increase at the rate of 10° F./min, while $T_{EMB}$ (relatively representative of the $T_{PROD}$) is assumed rise at 6.5° F./min. In the example, the temperature setpoint ($T_{SP}$) is 2000° F. and the allowable continuous operation temperature for the refractory is about 2500° F. In one option, if the operation was controlled using only the open TC, $T_{OPEN}$, then the temperature setpoint would be reached after about 3.2 hours (square symbols, upper line, and point A showing the intersection of the upper line and the setpoint). A controller would then begin decreasing energy input in the furnace (e.g., by decreasing burner firing rate or adjusting one or more other burner operating parameters), even though $T_{EMB}$ (indicative of $T_{PROD}$) is well below the furnace temperature setpoint $T_{SP}$. Thus, heating will be decreased prematurely, while the product temperature has not yet achieved setpoint. In another option, if the operation of the furnace was controlled using only the embedded TC, $T_{EMB}$, then the setpoint is reached after about 5 hours (circle symbols, lower line, and point C showing the intersection of the lower line and the setpoint). In the meantime, the $T_{OPEN}$ temperature would have exceeded allowable continuous operation temperature of the refractory by about 500° F. degrees.

A third, preferable option is to control the furnace using a more optimal operation variable, deemed $T_{CONTROL}$, which may be a calculated function of $T_{OPEN}$ and $T_{EMB}$, and optionally $T_{SP}$. In one non-limiting example equation for $T_{CONTROL}$, which is graphically shown in FIG. 13, (triangle symbols and middle line):

$$T_{CONTROL} = X \cdot T_{EMB} + (1 - X) \cdot T_{OPEN} \qquad \text{Equation (1)}$$

$$\text{where, } X = \text{Constant} * \left(\frac{T_{EMB}}{T_{OPEN}}\right)$$

In the depicted graph, the Constant is set at 0.8. The control temperature variable $T_{CONTROL}$ reaches the setpoint temperature at point B after about 4 hours, without allowing the $T_{OPEN}$ to exceed 2500° F., thereby gaining about 0.8 hours or 48 minutes of continuing to operate at high firing rate as compared with controlling based on $T_{OPEN}$ alone, which will enable the furnace to decrease cycle times and improve productivity. As an example, for a furnace being fired at 10 MMBtu/hr with specific fuel consumption of 0.8 MMBtu/ton and processing about 60 tons/batch, this exemplary control scheme enables the input of an additional 5 to 8 MMBtu more energy into the furnace over the same period of time, resulting in about 8 to 13% improvement in the productivity.

It is understood that many alternative functions of $T_{OPEN}$ and $T_{EMB}$ may be used to achieve improved process results compared with controlling based on either $T_{OPEN}$ or $T_{EMB}$ alone. In one example, $T_{CONTROL}$ may be formulated based on a difference between $T_{OPEN}$ and $T_{EMB}$ rather than a ratio, or some other relative weighting of $T_{OPEN}$ and $T_{EMB}$ than the linear example given above, In another example, $T_{CONTROL}$ may be varied taking into account a range about the setpoint temperature $T_{SP}$, wherein when $T_{OPEN}$ is within a range near $T_{SP}$, a formula is used to provide a relative weighting of $T_{OPEN}$ and $T_{EMB}$, while below that range $T_{OPEN}$ alone is used and above that range $T_{EMB}$ alone is used. (Note that this could be accomplished, for example, by setting X in equation (1) to 0 below the range and 1 above the range.) The range may have a lower limit that is 10% or 15% or 20% or 25% below $T_{SP}$, and the range may have an upper limit that is 10% or 15% or 20% or 25% above $T_{SP}$, and theses ranges can be adjusted appropriately depending on the temperature scale being used.

Figure 5:
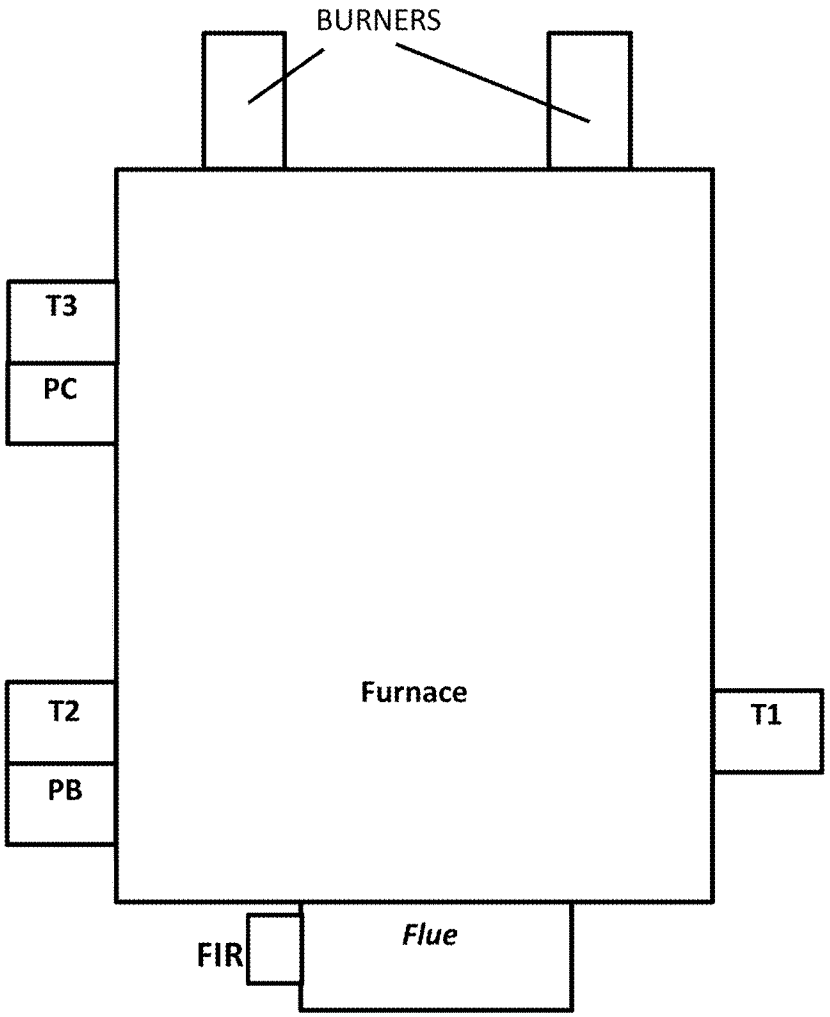
FIG. 5 is a top view schematic of an exemplary scrap melting furnace showing the location of burners, a flue, three exposed temperature sensors (T1, T2, T3), two optical pyrometers (PB, PC), and an infrared sensor (FIR).
Figure 6:
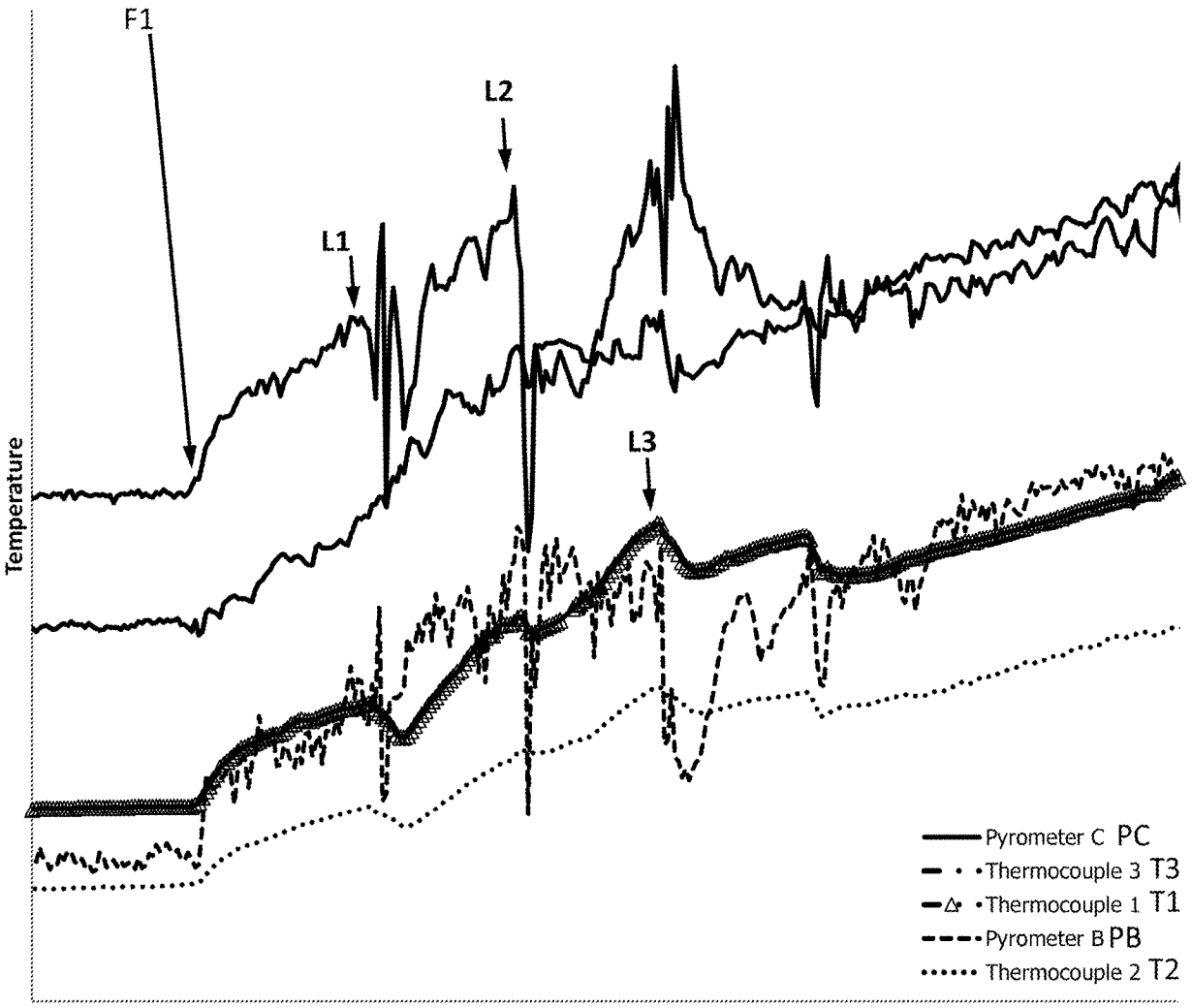
FIG. 6 is a graphical comparison of temperature measurements taken by two optical pyrometers directed to different portions of the furnace, and three exposed thermocouples positioned in the wall in different locations in the furnace, as shown in FIG. 5, during melting and the addition of three separate charges L1, L2, and L3.

With reference to FIGS. 5 and 6, experiments were conducted in a copper melting furnace using various temperature sensors to distinguish energy input requirements during loading of the furnace. Typically, while a copper furnace is being operated to melt scrap, an initial charge of scrap is placed into the furnace, and the subsequent charges of scrap are added as the previous charges melt down from solid to liquid and provide more space in the furnace to receive additional scrap material.

The furnace layout is shown in FIG. 5, which depicts a copper furnace instrumented with several temperature sensors. In the depicted furnace, burners are positioned in one end of the furnace and a flue is positioned at an opposite end of the furnace. Although two burners are shown in FIG. 5, any number of burners, one or more, may be used, and the systems and methods described herein are independent of the type of fuel used (gaseous, liquid, solid) and the type of burner (air-fuel, oxy-fuel, air-oxy-fuel). Also, the flue may be positioned at any suitable location of the furnace without affecting the general operation of systems and methods described herein.

As shown, the flue may be equipped with an infrared sensor (FIR) to detect combustion intensity. Positioned in the exemplary furnace of FIG. 5 are two optical pyrometers, pyrometer PC being near the burner end of the furnace and pyrometer PB being near the flue end of the furnace. Also positioned in the furnace are three exposed thermocouples, thermocouples T1 and T2 near the flue end of the furnace and on opposite sidewalls of the furnace, and thermocouple T3 in a sidewall near the burner end of the furnace. Exposed thermocouples are thermocouples mounted so that they are directly exposed to the environment inside the furnace, even if in some cases those thermocouples may be slightly recessed within a port in the furnace wall or in a sensor block to reduce furnace radiation impinging on the thermocouples and to reduce exposure from splashing metal. For purpose of evaluating the data of FIG. 5, it is noted that the furnace has a charge door (not shown) through which charge is dropped into the furnace such that added charge tends to accumulate toward the left side of the furnace where optical pyrometers PB and PC and exposed thermocouples T2 and T3 are located, and somewhat away from where exposed thermocouple T1 is located.

The data in FIG. 6 shows that a combination of two optical temperature sensors (pyrometers PB and PC) directed to different locations or zones or regions can provide knowledge of the energy distribution need in a furnace, particularly during loading of new scrap. Data is also shown for three exposed thermocouples (T1, T2, and T3) which do not respond as rapidly or decisively to the addition of charge to the furnace. Consequently, a method to control energy distribution based on the measurements of the two optical temperature sensors PB and PC would include a control scheme that distributes energy where it is needed, for example by increasing the firing rate of one burner targeting an area of relatively lower temperature and/or by decreasing the firing rate of another burner targeting an area of relatively higher temperature, or by adjusting the stoichiometry or staging of one or both burners, or by adjusting a flue damper to increase or decrease furnace pressure.

As shown in FIG. 6, compare what happens after the three marked loadings of scrap into the furnace, L1, L2, and L3. Note that the firing rate was increased at point F1, which resulted in a general increase in the temperature curves. After scrap loading L1, both pyrometers PB and PC show some perturbation, but neither indicates a disproportionate loading of scrap due to the charge L1. After scrap loading L2, while both pyrometers again respond, the perturbation of pyrometer PC shows a much larger temperature drop than the perturbation of pyrometer PB, indicating that a disproportionate amount of the cold charge L2 has likely fallen in a zone toward the burner end of the furnace. In response, burner operation can be adjusted to direct more heat to the burner end of the furnace. In contrast, after scrap loading L3, pyrometer PB shows a much larger temperature drop than pyrometer PC, indicating that a disproportionate amount of the cold charge L3 has likely fallen in a zone toward the flue end of the furnace, and in response, burner operation can be adjusted to direct more heat to the flue end of the furnace.

The open thermocouples shown in FIG. 6 typically show a similar temperature trend as the pyrometers, but they are much less sensitive to rapid changes in temperature during scrap loading. For example, exposed thermocouple T3 and pyrometer PC are located in the same vicinity, yet after scrap loading L2, pyrometer PC registers a much greater response than thermocouple T3. This shows that, in addition to strategic sensor placement, the selection of sensor type (pyrometer versus thermocouple in this case) makes a significant difference regarding the information obtained and the resultant ability to control the heat distribution within a furnace.

Figure 7:
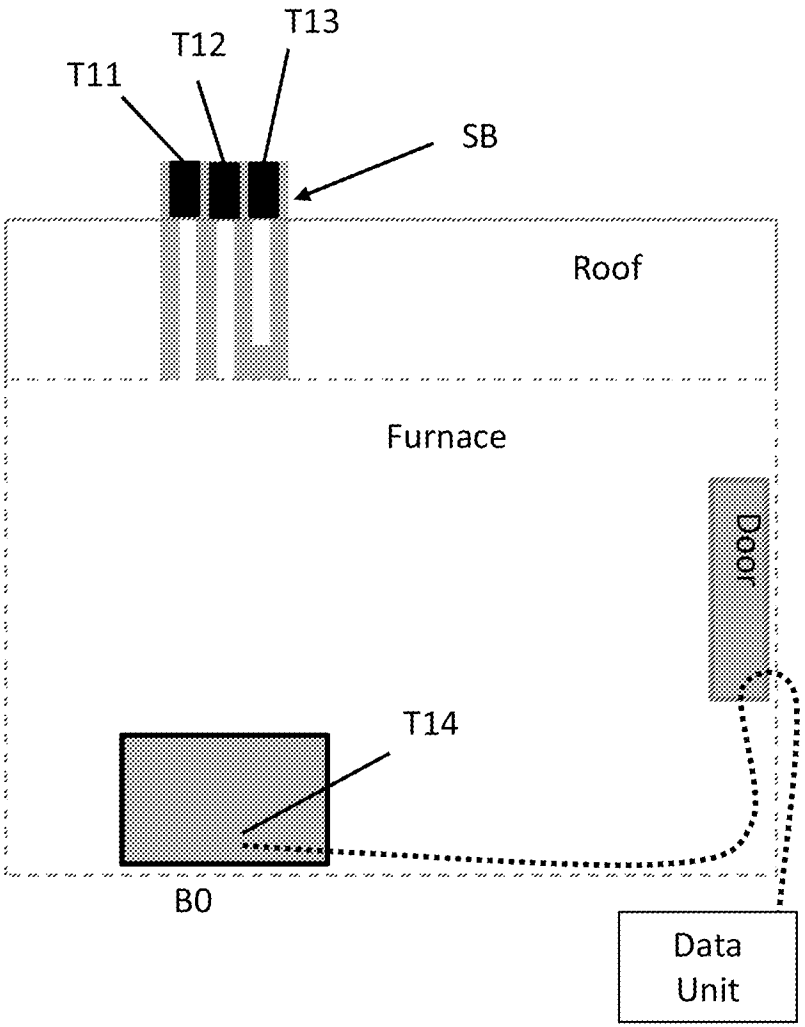
FIG. 7 is a side view schematic of an exemplary test furnace having a bed of metal (e.g., copper) to be heated, fitted with a bed thermocouple (T14), and including a sensor block mounted in the furnace roof containing three temperature sensors: an open thermocouple (T12), an embedded thermocouple (T13), and an optical pyrometer (T11).
Figure 8:
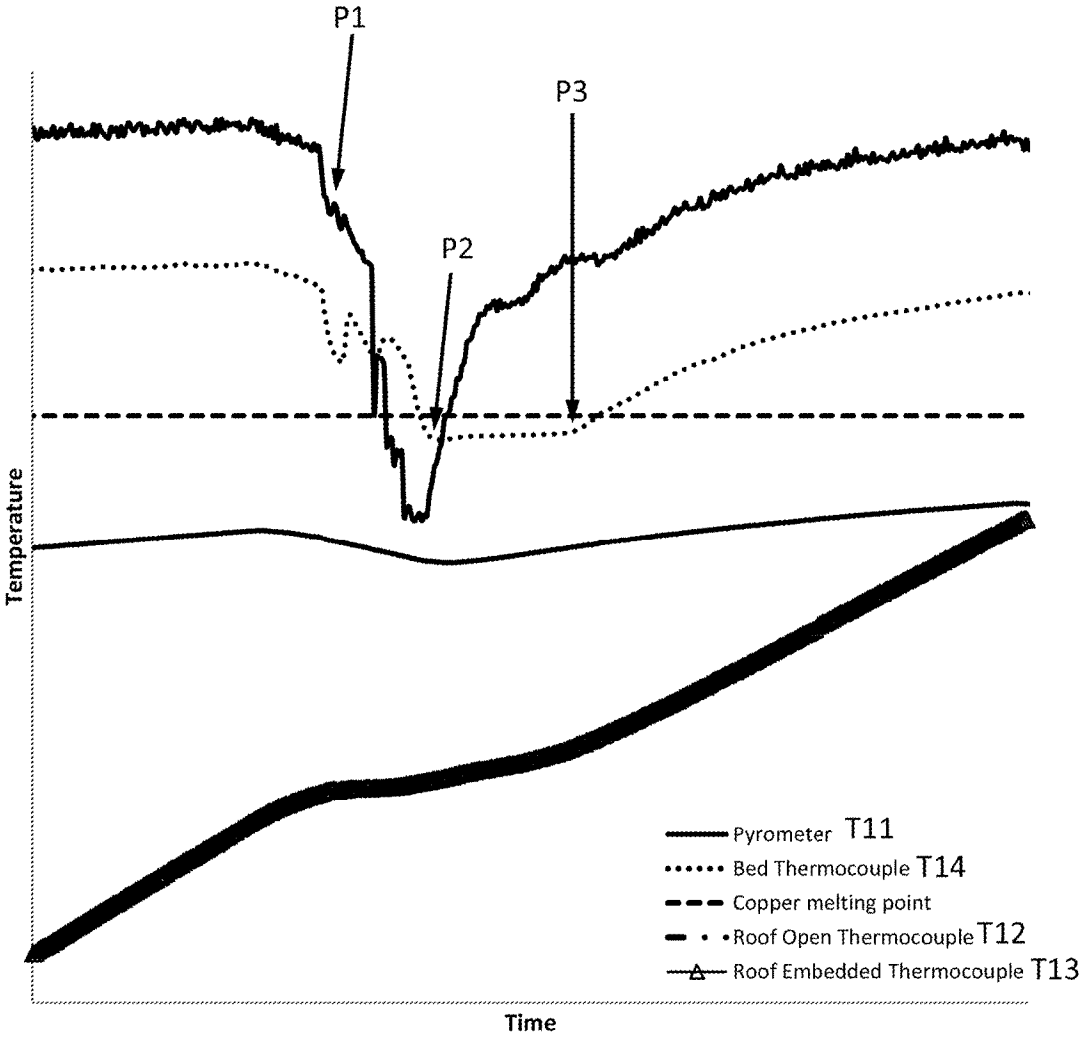
FIG. 8 is a graphical comparison of temperature measurements taken by the three temperatures sensors in a roof-mounted sensor block in a test furnace (T11, T12, T13), and the copper bed thermocouple (T14), as shown in FIG. 7, and in particular showing a correspondence between responses of the temperature sensors and the progress of the phase change (melting) of the copper.

With reference to FIGS. 7 and 8, experiments were conducted in a test furnace configured to melt a bed of copper (B0), using various temperature sensors to distinguish energy input requirements during loading of the furnace. The furnace and instrumentation layout is shown in FIG. 7. In the depicted furnace, a sensor block (SB) is used having three ports, an open port in which an optical pyrometer (T11) is positioned to view the bed of copper, an open port in which a thermocouple (T12) is positioned to be exposed to the furnace environment, and a blind port in which an embedded thermocouple (T13) is positioned to measure roof temperature. A bed thermocouple (T14) is positioned in the bed of copper.

The data in FIG. 8 shows generally that a combination of two temperature sensors (one open pyrometer T11 and one embedded thermocouple T13) can provide the ability to characterize local energy distribution (primarily indicated by the open temperature sensor) and energy input (primarily indicated by the embedded temperature sensor) into the furnace. The embedded thermocouple (T13) detects a need for additional energy input into the furnace as it can see the effect of fresh scrap being loaded or the furnace door being opened. The pyrometer (T11) senses the local change in heat and therefore a combination of pyrometers strategically located around a furnace could provide knowledge of zonal heat distribution that is an input to a control scheme to optimize the heating during various industrial processes that are not limited to copper melting (including, e.g., glass melting, metals re-heat, and re-cycle).

Point P1 marks the time when the furnace door was opened, the bed was stirred, and new scrap was added. The embedded thermocouple T13 detects the bulk heat change due to these operations, while the pyrometer T11 detects the resultant local change in energy distribution and the open thermocouple T12 similarly shows a more dramatic response to the influx of cold air and cold charge. The bed thermocouple T14 drops to or slightly below the melting temperature of copper at point P2, when the door has been closed and the new charge is being heated. The bed thermocouple T14 remains flat during the phase change until point P3, when melting is complete. The pyrometer T11 temperature curve shows a flattening during the phase change, before it resumes an upward trend. Note that the pyrometer temperature curve does not remain consistently flat during the phase change possibly due to some reflections from the burner flames and furnace walls.

As shown in FIG. 8, the combination of the open optical pyrometer T11 and the embedded thermocouple T13 can be used to detect substantial completion of a phase change (melting) of the copper. At the start of melting (point P2), the pyrometer T11 temperature curve shows a sharp increase, which is due to the top surface of the copper radiatively heating from above, as expected, with heat conducting from the top surface into the solid copper (see the response of the bed thermocouple T14). A portion of the initial sharp increase in pyrometer temperature T11 could also be explained by reflections of heat radiation from the burners. At the same time, the embedded thermocouple (T13) shows a steady increase in temperature as the furnace warms. As melting commences, the optical pyrometer temperature curve (T11) does not have the same flat (constant) profile as the corresponding bed thermocouple (T14), which is most likely due to the pyrometer detecting some radiative reflections from the burner flames and furnace walls. The bed thermocouple (T14) shows that the bed temperature remains constant, as is expected during a phase change, and the furnace temperature (T13) flattens out due to most of the input heat being absorbed by the copper phase change. Once the phase change is complete (the bed thermocouple T14 begins to rise), the upward slope of the embedded thermocouple (T13) increases, as does the upward slope of the optical pyrometer (T11).

Figure 9:
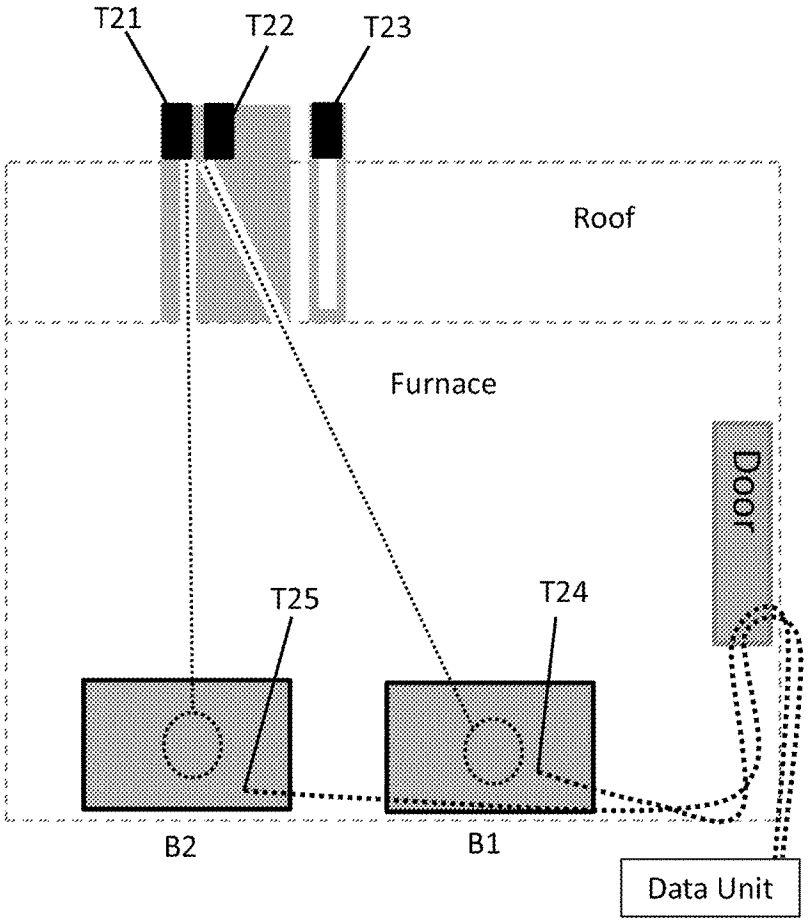
FIG. 9 is a side view schematic of an exemplary test furnace having a front bed of aluminum (B1) and a back bed of aluminum (b2) to be heated, each fitted with thermocouples (T24 and T25, respectively), and including a sensor block having two optical pyrometers, one directed at the front bed (T22) and the other directed at the back bed (T21), as well as a roof-mounted embedded thermocouple (T23).
Figure 10:
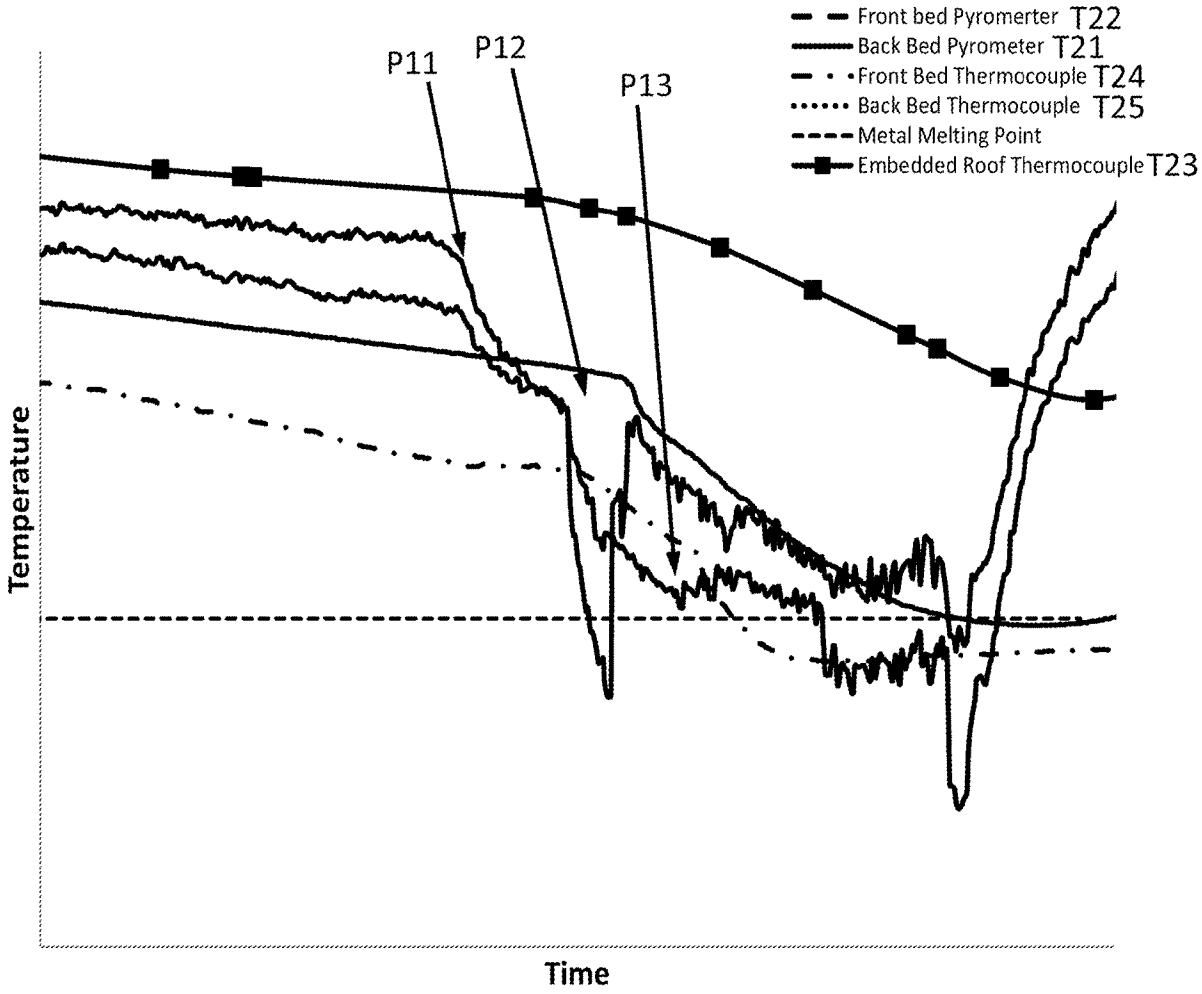
FIG. 10 is a graphical comparison of temperature measurements taken by the three roof-mounted temperature sensors in a test furnace (T21, T22, T23), and the front and back bed thermocouples (T24, T25), as shown in FIG. 9, and in particular showing the response of those temperature sensors to various process changes in the beds.

FIGS. 9 and 10 relate to another set of experiments conducted in a test furnace, in which two beds of material were heated, a front bed (B1) and a back bed (B2). In the depicted furnace, two sensor blocks are used to house three roof-mounted temperature sensors, although in an alternate embodiment, the sensors could all be located in the same sensor block. One depicted sensor block has two open ports, a straight open port housing an optical pyrometer (T21) positioned to measure the temperature of the back bed B2 and an angled open port housing an optical pyrometer (T22) positioned to measure the temperature of the front bed B1. A separate embedded thermocouple T23 is located in a different sensor block in the roof of the furnace. Bed thermocouples (T24 and T25) are located respectively in the front and back beds (B1 and B2).

The data of FIG. 10 shows that a combination of two optical temperature sensors, or one pyrometer and one embedded thermocouple, can provide a means to characterize local energy distribution and energy input into the furnace. Also an energy distribution control strategy may be devised based on one or both of: (a) reducing burner firing rate for a brief time period to enable a more accurate pyrometer reading unaffected by flame radiance in the furnace (i.e., so that the pyrometer measures closer to actual bed temperature), and (b) tempering the reaction speed of the burner control system by monitoring both the slower responding embedded roof thermocouple (T23) and the faster responding optical pyrometers (T21, T22). For example, the difference and/or the ratio of an open pyrometer temperature and an embedded thermocouple temperature could be kept with a certain range to control heating efficiently while avoiding overheating of the melt.

The data of FIG. 10 relates to the melting and loading processes for aluminum in two beds in a test furnace. After the door is opened, both beds (which already contain some aluminum) are stirred, and material is loaded into the front bed (B1) only. The two pyrometers (T21, T22) are able to distinguish different bed temperatures and different phases of metal in the two beds. The embedded roof thermocouple (T23) senses a drop in furnace heat when the door is opened and material is loaded. At point P11 the firing rate was decreased and the door was opened, at point P12 both beds B1 and B2 were stirred, and at point P13 more cold charge was added to the front bed B1. As in FIG. 8, FIG. 10 shows the ability of this combination of sensors to distinguish between energy distribution and energy input needs to the furnace.

Note that pyrometers are sensitive to the flame radiation, but when the burner firing rate is reduced (e.g., when loading), the pyrometer and thermocouple temperatures align very closely. Thus, more accurate pyrometer measurements may be obtained by placing sensor blocks away from the flame, or by taking pyrometer measurements where or when a flame is temporarily not present, or by corresponding or synchronizing a temporarily reduction in burner firing rate with the taking of a pyrometer and/or other optical temperature measurement.

As described herein, a ratio, difference, or other relationship between the open pyrometer and embedded thermocouple measurements, or open thermocouple and embedded thermocouple measurements, can be used to determine that the furnace should be heated faster or more slowly depending on that relationship, or that heat should preferentially be delivered to one or more zones of the furnace as compared to one or more other zones of the furnace. For instance, if the open/embedded ratio is greater than or equal to 2 (or 1.75 or 1.5 or 1.25), then the system may decrease firing rate to avoid overheating the refractory walls and roof. Conversely, if the open/embedded ratio is less than or equal to 1 (or 1.05 or 1.1 or 1.15 or 1.2), then the system may increase firing rate to enable faster heating without risk of damage to the refractory walls and roof.

Figure 11:
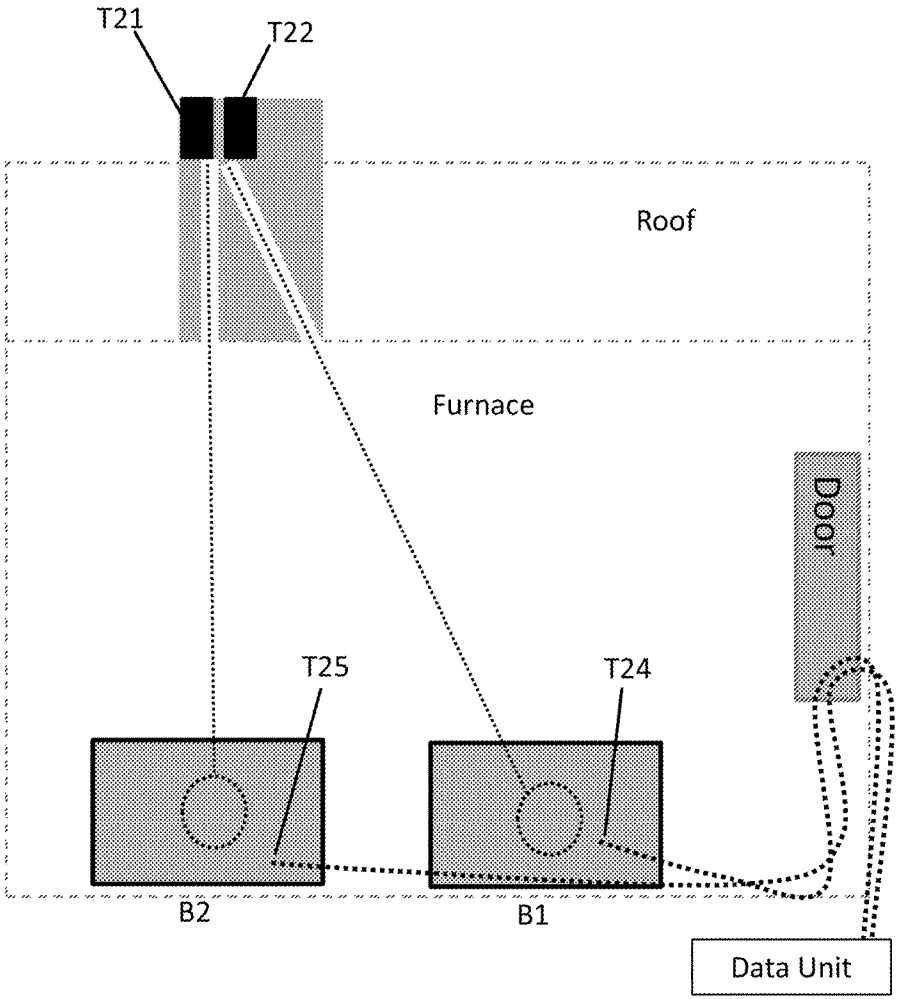
FIG. 11 is a side view schematic of an exemplary test furnace having a front bed of aluminum (B1) and a back bed of aluminum (B2) to be heated, each fitted with thermocouples (T24 and T25, respectively), and including a sensor block having two optical pyrometers, one directed at the front bed (T22) and the other directed at the back bed (T21).
Figure 12:
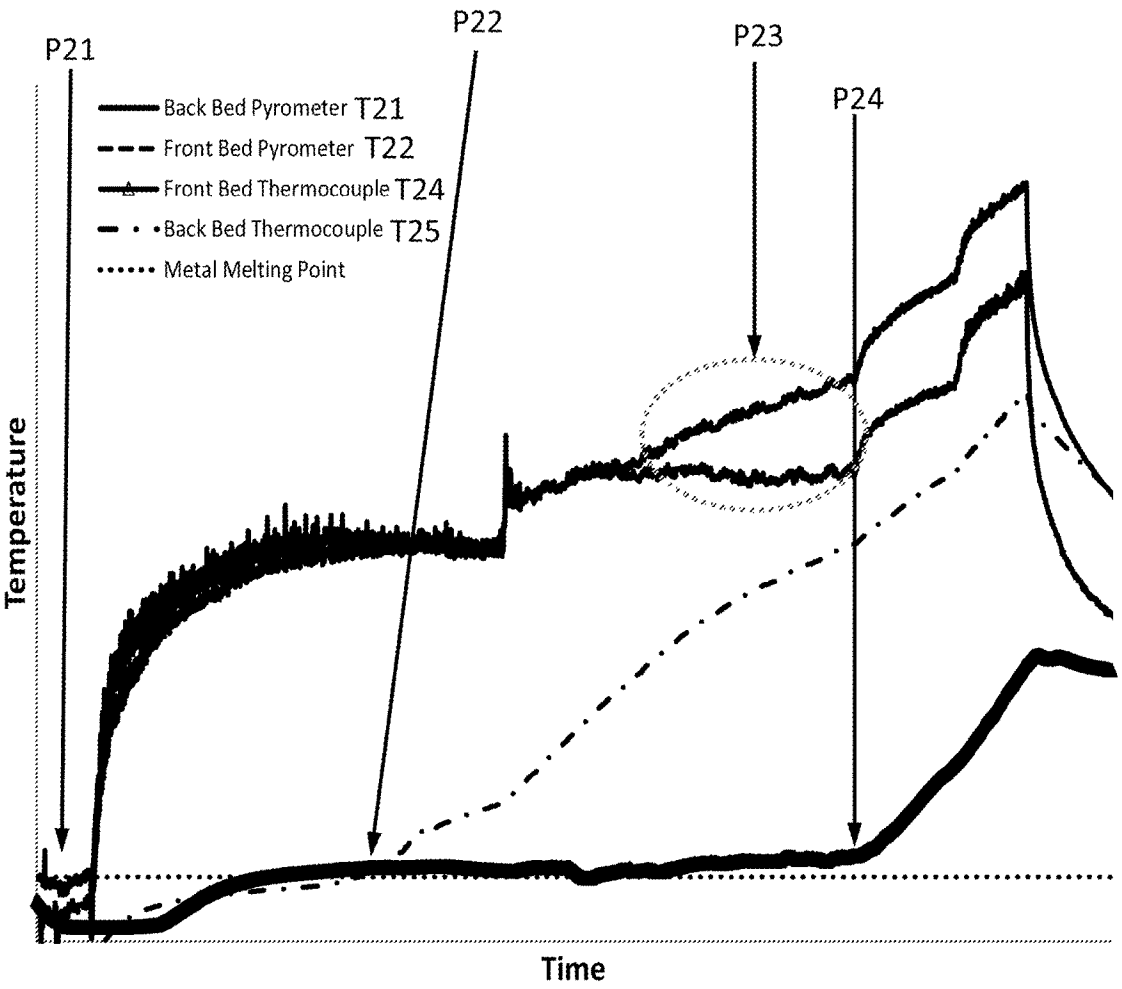
FIG. 12 is a graphical comparison of temperature measurements taken by the two roof-mounted temperature sensors in a test furnace (T21, T22), and the front and back bed thermocouples (T24, T25), as shown in FIG. 11, and in particular showing the response of those temperature sensors to various process changes in the beds.

FIGS. 11 and 12 relate to another set of experiments conducted in a test furnace, in which two beds of material were heated, a front bed (B1) and a back bed (B2). The layout of the furnace and instrumentation in FIG. 11 is essentially the same as in FIG. 9, except for the absence of the embedded roof thermocouple T23.

FIG. 12 shows that the two pyrometers (T21 and T22) are able to distinguish temperatures and phases of metal in the individual beds (B2 and B1, respectively). For this experiment, a small amount of aluminum was loaded in the back bed B2 and a larger amount of aluminum was loaded in the front bed B1. At point P21, cold charge was loaded in both beds B1 and B2, and shortly thereafter, the charging door was closed and burner firing rate increased. At point P22, back bed (B2) melting was substantially complete. At time region P23, the pyrometer signals (T21 and T22) start to diverge due to their respective beds (B2 and B1) being in different stages of melting. At point P24, front bed (B1) melting was substantially complete.

The data of FIG. 12 shows an increase in the temperature of the back bed pyrometer (T21) occurring earlier than an increase in the temperature of the front bed pyrometer (T22), which corresponds to the smaller amount of material in the back bed melting sooner than the larger amount of the material in the front bed. Among other things, this data reinforces the benefits of strategically placing sensors in a furnace to characterize the energy distribution and heating requirements.

A heating or melting furnace may be operationally divided into two or more zones, where the energy input and thus the temperature of each zone can, to at least some degree, be separately or differentially controlled by varying one or more furnace parameters that regulate energy input into the furnace.

Figure 14:
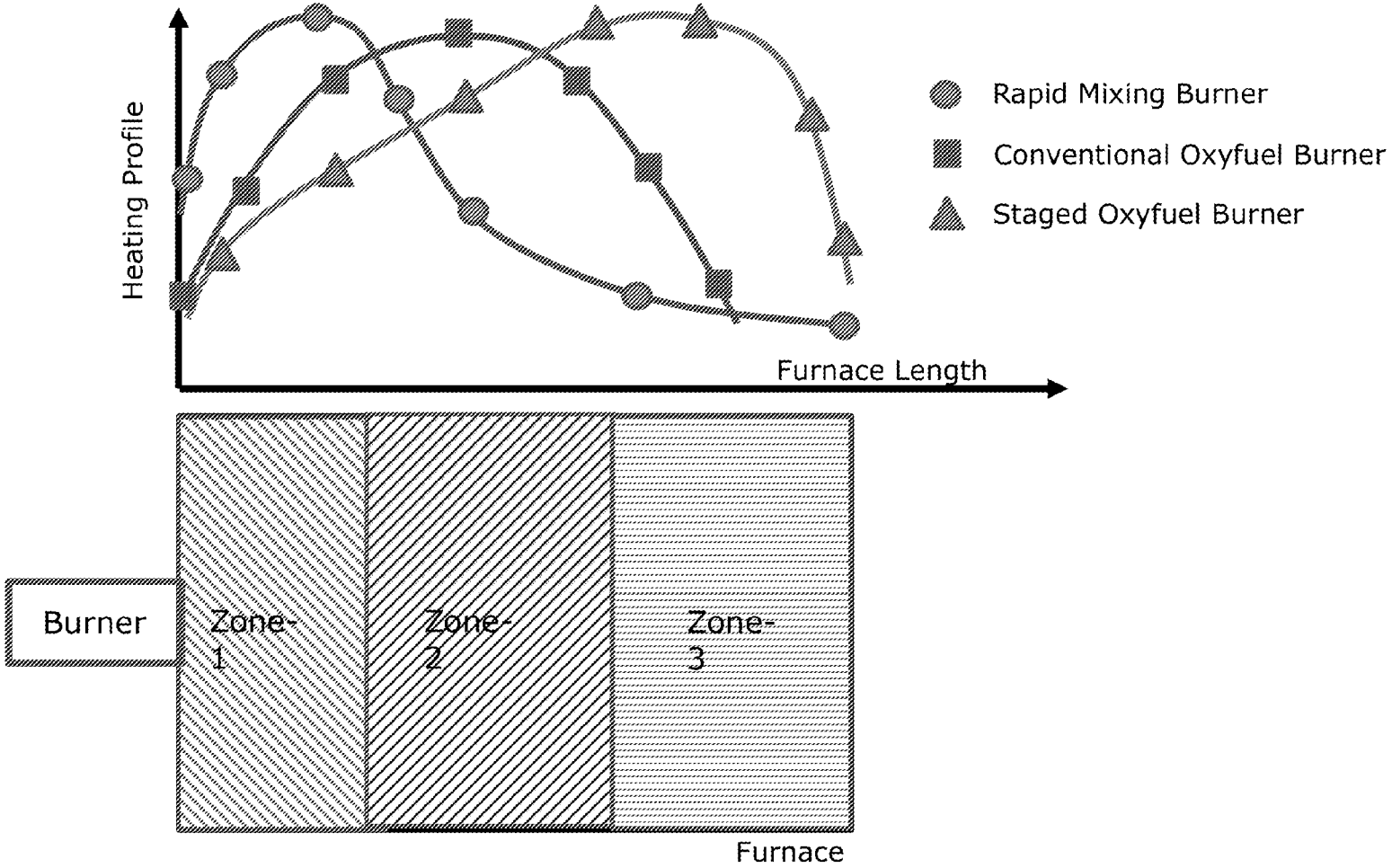
FIG. 14 is a graphic showing a furnace with multiple operational zones and the correspondence of different types of burners with different heating profiles that can preferentially direct disproportionate amounts of energy to the different zones, depending on heating needs.

In one common example, as illustrated in FIG. 14, a burner may be employed that has a particular heating profile relative to three operational zones in the furnace. A rapid mixing burner (such as disclosed in US 2013/0143168, by way of non-limiting example) has a heating profile releasing proportionally more combustion energy into Zone 1 of the furnace, nearest the burner, and successively less into Zones 2 and 3. A staged oxy-fuel burner (such as disclosed in U.S. Pat. No. 8,696,348 or US 2013/0143169, as non-limiting examples) has a heating profile resulting from more delayed combustion and thus releases proportionally more combustion energy into Zone 3 of the furnace, farthest from the burner, and successively less into Zones 2 and 1. A conventional oxy-fuel burner has a more intermediate heat release profile, with heat release building in Zone 1, peaking in Zone 2, and tapering off in Zone 3. Depending on the type of burner, one physical burner, or one set of burners, may be controlled to vary its operation from a rapid mixing mode to a conventional oxy-fuel mode to a staged oxy-fuel mode depending on the needs of the furnace, in response to where heat is needed at any particular time.

In another example, a burner such as is disclosed in US 20150247673 can be used to selectively and dynamically target or direct more heat preferentially into one or more zones of a furnace, and less heat preferentially into one or more other zones in the furnace, in order to achieve a desired zonal control.

The present invention is not to be limited in scope by the specific aspects or embodiments disclosed in the examples which are intended as illustrations of a few aspects of the invention and any embodiments that are functionally equivalent are within the scope of this invention. Various modifications of the invention in addition to those shown and described herein will become apparent to those skilled in the art and are intended to fall within the scope of the appended claims.

The invention claimed is:

1. An integrated sensor system for use in a furnace system including a furnace having a flue and at least one burner, the furnace containing a charge and having walls bounding a furnace environment, the walls including at least one of a side wall, an end wall, and a roof, the furnace having two or more zones each differently affected by at least one furnace parameter regulating energy input into the furnace, the integrated sensor system comprising:

a first temperature sensor positioned to measure a first temperature in the furnace;

a second temperature sensor positioned to measure a second temperature in the furnace, wherein the second temperature sensor responds less rapidly to changes in the furnace environment than the first temperature sensor; and a controller programmed to:

receive signals from the first and second temperatures sensors indicative of the first and second measured temperatures, respectively;

adjust operation of a furnace system parameter based on a relationship between the first and second temperatures, wherein the furnace system parameter includes at least one of a burner firing rate, a burner stoichiometry, a burner staging, a firing rate distribution among two or more burners, a staging distribution among two or more burners, and a furnace pressure, thereby differentially regulating energy input into at least two of the zones of the furnace;

control energy input into the furnace based on a signal from the second temperature sensor; and control energy distribution into the furnace based on a signal from the first temperature sensor;

wherein the relationship between the first and second temperatures is a function of one or more of a difference between the two temperatures, a ratio of the two temperatures, and a weighted average of the two temperatures.

2. The system of claim 1, wherein the first temperature sensor is mounted in a wall in a first zone of the furnace and exposed directly to the furnace environment; and wherein the second temperature sensor is embedded in a wall in the first zone of the furnace and isolated from direct exposure to the furnace environment.

3. The system of claim 1, wherein the first temperature sensor is an optical sensor oriented to detect the temperature of the charge in a first zone in the furnace; and wherein the second temperature sensor is an optical sensor oriented to detect the temperature of the charge in a second zone in the furnace.

4. The system of claim 1, wherein the first temperature sensor is an optical sensor oriented to detect the temperature of the charge in a first zone in the furnace; and wherein the second temperature sensor is embedded in a wall in the first zone of the furnace and isolated from direct exposure to the furnace environment.

5. The system of claim 1, wherein the furnace system parameter to be adjusted includes at least one of a burner firing rate, a burner stoichiometry, a burner staging, a firing rate distribution among two or more burners, a staging distribution among two or more burners, and a furnace pressure.

6. The system of claim 1, wherein the controller is programmed to monitor at least one of the temperature sensor signals intermittently.

7. The system of claim 1, further comprising at least a third sensor selected from the group consisting of: temperature sensors, pressure sensors, concentration sensors, radiation sensors, density sensors, optical sensors, acoustic sensors, level sensors, angle sensors, distance sensors, position sensors, image acquisition sensors, and video acquisition sensors.

8. The system of claim 7, further comprising an actuator mechanism corresponding to the third sensor for advancing the third sensor into a position for taking a measurement and retracting the third sensor to a protected position;

wherein the controller is programmed to monitor the signal from third sensor only when the third sensor is advanced into the position for taking a measurement.

9. The system of claim 1, further comprising:

a sensor block mounted in a wall in a first zone of the furnace and having at least two ports in which the first and second temperature sensors are respectively positioned.

10. A method of controlling one or both of energy input and energy distribution in a furnace using an integrated sensor system as in claim 1, comprising:

receiving a first temperature signal from the first temperature sensor to determine the first temperature;

receiving a second temperature signal from the second temperature sensor to determine the second temperature;

adjusting a furnace system parameter based on a relationship between the first and second temperatures, wherein the furnace system parameter includes at least one of a burner firing rate, a burner stoichiometry, a burner staging, a firing rate distribution among two or more burners, a staging distribution among two or more burners, and a furnace pressure, thereby differentially regulating energy input into at least two of the zones of the furnace;

controlling energy input into the furnace based on a signal from the second temperature sensor; and controlling energy distribution into the furnace based on a signal from the first temperature sensor;

wherein the first temperature sensor responds more rapidly to changes in the furnace environment than the second temperature sensor.

11. The method 10, further comprising:

calculating a ratio of the first and second temperatures; and controlling one or both of the energy input and energy distribution based on the calculated ratio.

12. The method of claim 10, wherein the first temperature sensor is mounted in a wall of the furnace and exposed directly to the furnace environment and the second temperature sensor is embedded in a wall of the furnace and isolated from direct exposure to the furnace environment, wherein both the first and second temperature sensors are positioned to measure temperatures in the same zone in the furnace; and wherein the controlling step includes adjusting energy input into the furnace based on a function of one or more of the difference between the first and second temperatures, the ratio of the first and second temperatures, and a weighted average of the first and second temperatures.

13. The method of claim 10, wherein the first and second temperature sensors are optical pyrometers directed respectively at first and second locations in the furnace, wherein the controlling step includes adjusting energy distribution into the furnace based on a function of one or more of the difference between the first and second temperatures, the ratio of the first and second temperatures, and a weighted average of the first and second temperatures.

14. A method of controlling heat distribution in a furnace using one or more integrated sensor systems as in claim 1, comprising:

detecting a heat requirement in one zone of the furnace using one of the first temperature sensor and the second temperature sensor;

detecting a heat requirement in another zone of the furnace using the other of the first temperature sensor and the second temperature sensor;

adjusting the input of combustion energy to the respective zones of the furnace based on the detected heat requirements.

* * * * *